US006901931B2

(12) United States Patent
Turesin

(10) Patent No.: US 6,901,931 B2
(45) Date of Patent: Jun. 7, 2005

(54) PERSONAL NOVELTY APPARATUS

(76) Inventor: Elisa Turesin, 1731 Walnut Dr., Mountain View, CA (US) 94040

( * ) Notice: Subject to any disclaimer, the term of this patent is extended or adjusted under 35 U.S.C. 154(b) by 0 days.

(21) Appl. No.: 10/267,190

(22) Filed: Oct. 8, 2002

(65) Prior Publication Data

US 2003/0131450 A1 Jul. 17, 2003

Related U.S. Application Data

(60) Provisional application No. 60/327,857, filed on Oct. 9, 2001.

(51) Int. Cl.[7] ..... A61G 15/00

(52) U.S. Cl. ..... 128/845; 128/869

(58) Field of Search ..... 602/24, 23; 128/845, 128/882, 869

(56) References Cited

U.S. PATENT DOCUMENTS 1,230,512 A 6/1917 Poehner
1,345,750 A * 7/1920 De Beaumont ..... 24/594.11
5,092,592 A 3/1992 FitzMaurice
5,558,628 A 9/1996 Bzoch
6,254,561 B1 * 7/2001 Borden ..... 602/24

* cited by examiner

*Primary Examiner*—Henry Bennett
(74) *Attorney, Agent, or Firm*—Anthony T. Cascio

(57) ABSTRACT

A personal novelty apparatus includes a pair of elongated members and a pair of fasteners. Each of the members has a planar surface and a plurality of bores. The bores are disposed in the planar surface and extend through the elongated members. The elongated members are adapted to be disposed with the planar surface of a first one of the members being in a facing relationship to the planar surface of a second one of the members wherein the facing relationship may vary from a minimal overlap of the planar surface of each of the members to a maximum overlap of the planar surface of each of the members. When so disposed, at least two of the bores of the first one of the members are axially aligned with at least two of the bores of the second one of the members. A third one of the bores in each of the members is provided to releasably attach a user wearable device. Each of the fasteners is adapted to be disposed through a respective one of the axially aligned bores in each of members. When fastened to each other the first member and the second member form a rigid elongated structure.

20 Claims, 1 Drawing Sheet

PERSONAL NOVELTY APPARATUS

RELATED APPLICATION DATA

The present application claims priority from U.S. Provisional Patent Application 60/327,857 filed Oct. 9, 2001.

BACKGROUND OF THE INVENTION

The present invention relates generally to personal novelty apparatus and more particularly to a type of personal novelty apparatus commonly referred to as a spreader bar.

Personal novelty apparatus are a class of device useful in activities engaged in between consenting adults. Many types of such apparatus are well known. One particular class of such novelty apparatus is known as a spreader bar.

A spreader bar is typically utilized when a user is to be restrained such that the limbs of the user, i.e., the arms or the legs, are to be maintained in a fixed spaced apart position. Known spreader bars typically include a fixed length of a tubular rigid material. At each end of this type of spreader bar, a cuff or other device useful for grasping the limb of the user is attached. In use, each cuff is attached to a respective limb whereby the limbs are maintained in a spread apart position commensurate with the fixed length of the spreader bar. A disadvantage and limitation of known fixed length spreader bars is that several spreader bars of differing lengths are required to obtain various spread apart positions of the user or to accommodate users of different sizes.

To overcome this disadvantage and limitation, length adjustable spreader bars are also known. One known length adjustable spreader bar includes two elongated tubular members, where in the outside diameter of one member is substantially equal to the inside diameter of the other member such that the members may be coaxially disposed in a telescoping relationship. Radial bores are equidistantly disposed along the length of each of the tubular members. The members are telescoped until the spreader bar is at the desired length. A pin is inserted through each member whereat a bore in each member is axially aligned, preferably near the midsection of the assembled spreader bar. As with the fixed length spreader bar, the cuffs or other restraining devices are attached at the ends of the spreader bar. In particular, one cuff is attached to the distal end of each respective tubular member.

A disadvantage and limitation of the spreader bar constructed from telescoping members is that as the telescoping members reach full extension, the clearance required between the outside diameter of the smaller member and the inside diameter of the larger member may be sufficiently large such that a torque developed about the pin would allow each member to rotate slightly with respect to each other about the axis of the pin, thereby causing each tubular member to have its axis skewed with respect to the axis of the other tubular member. The skewed axes of the tubular members would then develop stresses at the inner ends of each tubular member whereat the inner end contacts the other spreader bar. These stresses may in turn cause failure of the spreader bar, which may possibly cause injury to the user or partner of the user.

A further disadvantage and limitation of each of the above described spreader bars is that the cuffs or other restraining devices are fixedly attached at the distal ends of the spreader bar. No provision is paid for the attachment of the cuffs at other locations or for the attachment of additional devices, which may be desirable or useful.

SUMMARY OF THE INVENTION

Accordingly, it is a primary object of the present invention to overcome one or more disadvantages and limitations of the prior art hereinabove enumerated. It is an important object of the present invention to provide an adjustable spreader bar that eliminates the torque about pin of the adjustable spreader bar as hereinabove described thereby improving safety to the user. It is a further object of the present invention to provide an adjustable spreader bar wherein the cuffs or other restraining devices may be attached at multiple locations. It is another object of the present invention to provide an adjustable spreader bar wherein multiple devices may be attached thereto.

According to the present invention, a personal novelty apparatus includes a pair of elongated members and a pair of fasteners. Each of the members has a planar surface and a plurality of bores. The bores are disposed in the planar surface and extend through the elongated members. The elongated members are adapted to be disposed with the planar surface of a first one of the members being in a facing relationship to the planar surface of a second one of the members wherein the facing relationship may vary from a minimal overlap of the planar surface of each of the members to a maximum overlap of the planar surface of each of the members. When so disposed, at least two of the bores of the first one of the members are axially aligned with at least two of the bores of the second one of the members. A third one of the bores in each of the members is provided to releasably attach a user wearable device. Each of the fasteners is adapted to be disposed through a respective one of the axially aligned bores in each of members. When fastened to each other the first member and the second member form a rigid elongated structure.

A feature of the present invention is that the two elongated members, being disposed in facing relationship, are secured to each other by a pair of fasteners wherein each of the fasteners is disposed in a respective one of the axially aligned bores in each member. The advantage of such attachment is that the facing surfaces of each member are flush with each other, thereby having substantially zero clearance therebetween, and the two fasteners prevent torque from being developed about a single pin as found in the prior art. Another feature the present invention is that the plurality of bores in each of the members may be advantageously use to attach multiple devices at any location along the length of the elongated combination of the two members. Accordingly, the novel spreader bar of the present invention may be used, not only to secure a single user in various positions, but also to secure multiple users to each other.

These and other objects, advantages and features of the present invention will become readily apparent to those killed in the art from a study of the following Description of the Exemplary Preferred Embodiments when read in conjunction with the attached Drawing and the appended claims.

DESCRIPTION OF THE EXEMPLARY PREFERRED EMBODIMENTS

Figure 1:
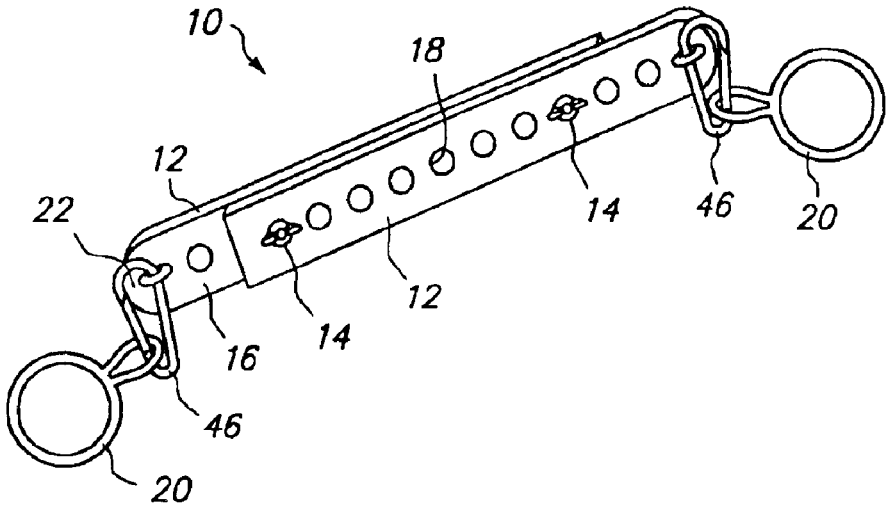
FIG. 1 is a perspective view of a spreader bar constructed according to the principles of the present invention.
Figure 2:
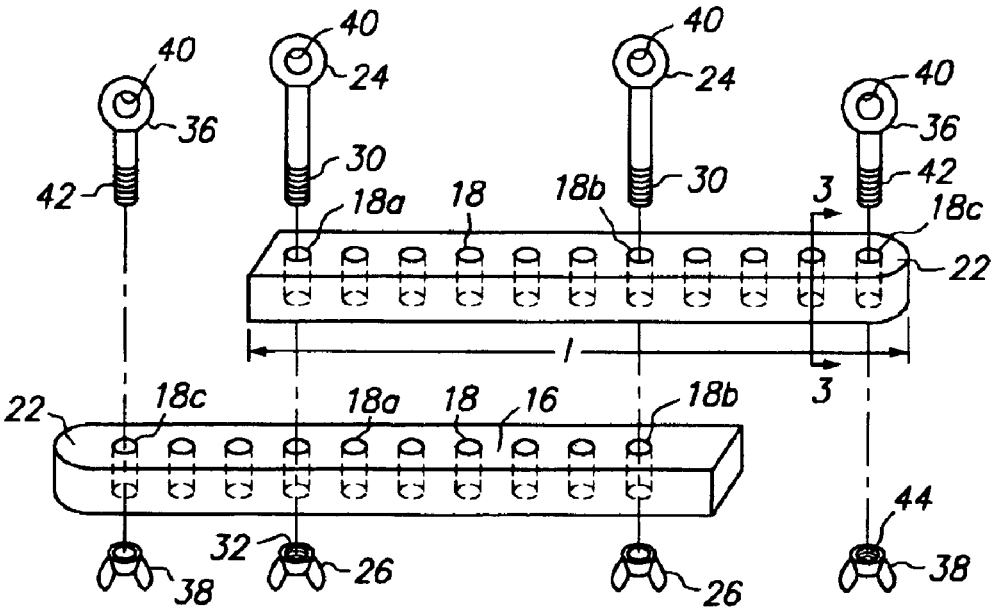
FIG. 2 is an exploded view of the spreader bar of FIG. 1.

Referring now to FIGS. 1–2, there is shown a spreader bar 10 constructed according to the present invention. The spreader bar 10 includes a pair of elongated members 12 and a pair of fasteners 14.

Each of the elongated members includes a planar surface 16 and a plurality of bores 18. The elongated members 12 are adapted to be disposed with the planar surface 16 of a first one of the members 12 being in a facing relationship to the planar surface 16 of a second one of the members 12. The facing relationship may vary from a minimal overlap of the planar surface 16 of each of the members 12 to a maximum overlap of the planar surface 16 of each of the members 12.

For maximum overlap, each planar surface 16 completely faces the other wherein any two of the bores 18 of the first one of said members 12 are axially aligned with a corresponding two of the bores 18 of the second one of said members 12. The minimal overlap of the planar surfaces 16 is preferably limited such that at least two of the bores 18 of the first one of said members 12 are axially aligned with at least two of the bores 18 of the second one of said members 12. For example, bores 18*a* and 18*b* of each of the members 12 become axially aligned with minimal overlap of the planar surfaces 16 thereby defining a maximum extension of the spreader bar 10.

A third one 18*c* of the bores 18 in each of said members is provided to releasably attach a user wearable device 20. The third one 18*c* of the bores 18 need not be limited to the bore 18*c* shown in FIGS. 1–2, but may be any such bore 18 selected by a user.

Each of the fasteners 14 is adapted to be disposed through a respective one of the axially aligned bores 18 in each of members 12. Accordingly, when fastened to each other the elongated members 12 form a rigid elongated structure.

In one particular embodiment of the present invention, the bores 18 in each of the elongated members 12 may be disposed normal to the planar surface 16. Furthermore, the bores 18 may also be spaced equidistantly along a length, l, of each of the members 12.

Figure 3:
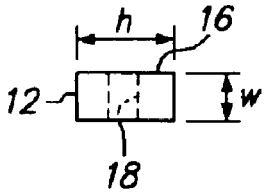
FIG. 3 is a cross sectional view taken along line 3—3 of FIG. 1.

With further reference to FIG. 3, each of the elongated members 12 may further be substantially rectangular in cross section. Each of the rectangular elongated members 12 has a major dimension, h, and a minor dimension, w. As best seen in FIG. 3, the planar surface 16 is coextensive with the major dimension, h.

As best seen in FIG. 1, each of the members 12 may further have an arcuate end portion 22. The arcuate end portion 22 may further be coextensive with the minor dimension, w. In one particular embodiment of the present invention, the arcuate end portion 22 has a diameter substantially equal to or greater than the major dimension, h. The arcuate end portion 22 is provided to present a rounded surface to the user.

As best seen in FIG. 2, each of the fasteners 14 includes an eyebolt 24 and a wing nut 26. Each eyebolt 24 has a eye portion 28 and a threaded shank 30. The wing nut 26 has a threaded bore 32. The threaded bore 32 is adapted to receive the threaded shank 30 when the shank 30 is axially disposed through one of the axially aligned bores 18, as seen above in reference to FIGS. 1–2. The eye portion 28 of each bolt 24 and the wing nut 26 facilitate gripping and manipulation by hand to obviate the necessity of using tools.

An additional pair of eyebolts 36 and a corresponding pair of wing nuts 38 may also be provided for attaching the user wearable devices to the spreader bar 10. Identical in construction to the above-described eyebolt 24 and wing nut 26, each of the additional eyebolts 36 has an eye portion 40 and a threaded shank 42. Each wing nut 38 has a threaded bore 44. The threaded bore 44 is adapted to receive the threaded shank 42 when the shank 42 is axially disposed through the user selected third one 18*c* of the bores 18. The eye portion 40 is adapted to mount a respective one of the user wearable devices 20.

Figure 4A:
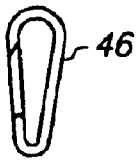
FIGS. 4A and 4B is a perspective view of a quick release clamp of FIG. 1
Figure 4B:
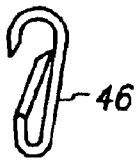

To releasably attach each wearable device 20 to the spreader bar 10, a pair of quick release clamps 46, one of which as best seen in FIG. 4, may be further provided. The clamp is preferably made from spring steel so that it is moveable between its closed position of FIG. 4A and its open position of FIG. 4B. Accordingly, each clamp 46 may releasably secure one of the user wearable devices 20 to a respective one of the eye portions 40. For example, the user wearable devices 20 may include a pair of cuffs secured to the limbs of a user.

There have been described herein exemplary preferred embodiments of a personal novelty apparatus. Those skilled in the art may now make numerous uses of, and departures from, the hereinabove described embodiments without departing from the inventive principles disclosed herein. Accordingly, the present invention is to be defined solely by the lawfully permissible scope of the appended claims.

What is claimed as the invention is:

1. A personal novelty apparatus comprising:

a pair of elongated members, each of said members having a planar surface and a plurality of bores in said planar surface disposed therethrough, said elongated members being adapted to be disposed with said planar surface of a first one of said members being in a facing relationship to said planar surface of a second one of said members wherein said facing relationship may vary from a minimal overlap of said planar surface of each of said members to a maximum overlap of said planar surface of each of said members, further wherein at least two of said bores of said first one of said members are axially aligned with at least two of said bores of said second one of said members, and further wherein a third one of said bores in each of said members is provided to releasably attach a respective one of user wearable devices; and a pair of fasteners, each of said fasteners being adapted to be disposed through a respective one of said axially aligned ones of said bores in each of members such that when fastened to each other said members form a rigid elongated structure, each of said fasteners including an eyebolt and a wing nut, said eyebolt having an eye portion and a threaded shank, said wing nut having a threaded bore, said threaded bore being adapted to receive said threaded shank when said shank is axially disposed through said respective one of said axially aligned bores.

2. An apparatus as set forth in claim 1 wherein said bores are disposed normal to said planar surface.

3. An apparatus as set forth in claim 2 wherein said bores are spaced equidistantly along a length of each of said members.

4. An apparatus as set forth in claim 1 wherein each of said elongated members is substantially rectangular in cross section having a major dimension and a minor dimension, said planar surface being coextensive with said major dimension.

5. An apparatus as set forth in claim 4 wherein each of said members has an arcuate end portion.

6. An apparatus as set forth in claim 5 wherein said arcuate end portion is coextensive with said minor dimension.

7. An apparatus as set forth in claim 6 wherein said arcuate end portion has a diameter substantially equal to said major dimension.

8. An apparatus as set forth in claim 1 further comprising a pair of additional eyebolts each having an eye portion and a threaded shank, and a pair of additional wing nuts each having a threaded bore, said threaded bore of one of said additional wing nuts being adapted to receive said threaded shank of one of said additional eyebolts when said shank of said one of said additional eyebolts is axially disposed through said third one of said bores in one of said elongated members, each eye portion being adapted to mount a respective one of said devices.

9. An apparatus as set forth in claim 8 further comprising a pair of quick release clamps, each of said clamps being adapted to releasably secure said respective one of said devices to said eye portion.

10. An apparatus as set forth in claim 8 wherein said devices include a pair of cuffs to secure the limbs of a user.

11. A personal novelty apparatus comprising:

a pair of elongated members, each of said members having a planar surface and a plurality of bores in said planar surface disposed therethrough, said elongated members being adjacently disposed with said planar surface of a first one of said members being in a facing relationship to said planar surface of a second one of said members wherein said facing relationship may vary from a minimal overlap of said planar surface of each of said members to a maximum overlap of said planar surface of each of said members, further wherein at least two of said bores of said first one of said members are axially aligned with at least two of said bores of said second one of said members, and further wherein a third one of said bores in each of said members is provided to releasably attach a respective one of user wearable devices; and a pair of fasteners, each of said fasteners being disposed through a respective one of said axially aligned ones of said bores in each of members to fasten to each other said members to form a rigid elongated structure, each of said fasteners including an eyebolt and a wing nut, said eyebolt having an eye portion and a threaded shank, said wing nut having a threaded bore, said threaded bore receiving said threaded shank when said shank is axially disposed through said respective one of said axially aligned bores.

12. An apparatus as set forth in claim 11 wherein said bores are disposed normal to said planar surface.

13. An apparatus as set forth in claim 12 wherein said bores are spaced equidistantly along a length of each of said members.

14. An apparatus as set forth in claim 11 wherein each of said elongated members is substantially rectangular in cross section having a major dimension and a minor dimension, said planar surface being coextensive with said major dimension.

15. An apparatus as set forth in claim 14 wherein each of said members has an arcuate end portion.

16. An apparatus as set forth in claim 15 wherein said arcuate end portion is coextensive with said minor dimension.

17. An apparatus as set forth in claim 16 wherein said arcuate end portion has a diameter substantially equal to said major dimension.

18. An apparatus as set forth in claim 11 further comprising a pair of additional eye bolts each having an eye portion and a threaded shank, and a pair of additional wing nuts each having a threaded bore, said threaded bore of one of said additional wing nuts receiving said threaded shank of one of said additional eyebolts, said shank of one of said additional eyebolts being axially disposed through said third one of said bores in one of said elongated members, each eye portion being adapted to mount a respective one of said devices.

19. An apparatus as set forth in claim 18 further comprising a pair of quick release clamps, each of said clamps releasably securing a respective one of said devices to said eye portion.

20. An apparatus as set forth in claim 18 wherein said devices include a pair of cuffs to be worn about the limbs of a user.

* * * * *